United States Patent [19]

Goto et al.

[11] 3,940,299

[45] Feb. 24, 1976

[54] METHOD FOR PRODUCING SINGLE-ORIENTED ELECTRICAL STEEL SHEETS HAVING A HIGH MAGNETIC INDUCTION

[75] Inventors: Isamu Goto; Isao Matoba, both of Chiba; Takuichi Imanaka, Kobe; Ko Matsumura, Chiba; Yoh Shimizu, Chiba; Tomomichi Goto, Chiba; Takahiro Kan, Chiba, all of Japan

[73] Assignee: Kawasaki Steel Corporation, Kobe, Japan

[22] Filed: Sept. 26, 1974

[21] Appl. No.: 509,539

[30] Foreign Application Priority Data

Oct. 31, 1973 Japan ..... 48-121762

[52] U.S. Cl. ..... 148/111; 148/31.55; 148/112; 75/123 L

[51] Int. Cl.[2] ..... H01F 1/04

[58] Field of Search ..... 148/111, 112, 31.55; 75/123 L

[56] References Cited

UNITED STATES PATENTS

| | | | |
|---|---|---|---|
| 2,209,687 | 7/1940 | Crafts | 148/111 |
| 3,157,538 | 11/1964 | Imai et al. | 148/111 |
| 3,700,506 | 10/1972 | Tanaka et al. | 148/111 |
| 3,802,936 | 4/1974 | Goto et al. | 148/111 |
| 3,841,924 | 10/1974 | Sakakura et al. | 148/111 |
| 3,853,641 | 12/1974 | Sakakura et al. | 148/111 |
| 3,855,018 | 12/1974 | Salsgiver et al. | 148/112 |

FOREIGN PATENTS OR APPLICATIONS

| | | | |
|---|---|---|---|
| 38-8214 | 6/1963 | Japan | 148/111 |

OTHER PUBLICATIONS

Saito, T; *Effect of Minor Elements on Grain Growth in Singly Oriented Si-Steel*, in Nihon Kinzoku, 27, 1963, pp. 186–191.

*Primary Examiner*—Walter R. Satterfield

[57] ABSTRACT

Single-oriented electrical steel sheets having a high magnetic induction are produced by combining specifically limited conditions in the composition of raw material, the final cold rolling reduction rate and in the secondary recrystallizing annealing.

3 Claims, 7 Drawing Figures

METHOD FOR PRODUCING SINGLE-ORIENTED ELECTRICAL STEEL SHEETS HAVING A HIGH MAGNETIC INDUCTION

The present invention relates to a method of producing the so-called single-oriented electrical steel sheets of strip having a high magnetic induction and an easily magnetization axis <100> in the rolling direction of the steel sheets or strips in metallurgy.

The single-oriented electrical steel sheets are mainly used as the iron core of a transformer and other electrical devices. As to the magnetic characteristics, the supply of the electrical steel sheet having a high magnetic induction and a low iron loss as well as a low magnetic striction is earnestly required by manufactured of electrical devices.

The magnetic characteristics are generally represented by $B_8$ value, that is, the magnetic induction at 800 A/*m* of magnetic field, and recently $B_8$ value of more than 1.85 W*b*/*m*$^2$ is required.

An object of the present invention is to provide a method for producing electrical steel sheets or strips of $B_8$ value of more than 1.85 W*b*/*m*$^2$.

In order to obtain the oriented silicon steel sheets having excellent magnetic properties, it is necessary that the secondary recrystallization is completely carried out in the final annealing step to fully develop (100) [001] aggregation structure. For the purpose, the growth of the primary recrystallized grains should be suppressed until a high temperature at which the secondary recrystallization occurs.

The suppress of the normal grain growth of the primary recrystallized grains has been generally effected by utilizing MnS, MnSe and the like. However, in such a conventional process wherein said dispersed precipitates are utilized, the aggregation of the secondary recrystallized grains of (110) [001] orientation is not sufficient and $B_8$ value of only about 1.85 W*b*/*m*$^2$ is obtained.

Recently A*l*N has been proposed as the precipitate capable of very highly aggregating the secondary recrystallized grains of (110) [001] orientation, for example, as proposed in U.S. Pat. No. 3,287,183, that is, the complementary addition of AlN combined with the usual normal grain growth inhibitor, such as S, Se or Te, has made a remarkable improvement of $B_8$ value to more than 1.85 W*b*/*m*$^2$, wherein such processes are characterized in that firstly a limited high temperature annealing prior to the final cold rolling is effected in order to disperse A*ln* finely and secondly a final cold rolling is effected with a narrow range of high reduction. However, such means is deficient in the stability in the commercial production.

Another object of the present invention is to provide a method for producing electrical steel sheets having a magnetic induction of more than 1.85 W*b*/*m*$^2$ in a commerically stable step.

The first aspect of the present invention consists in a method for producing single-oriented electrical steel sheets having a very high magnetic induction of more than 1.85 W*b*/*m*$^2$ in which a silicon steel raw material containing less than 4% of Si and less than 0.06% of C is hot rolled and repeatedly subjected to annealing steps and cold rolling steps to prepare a cold rolled steel sheet having a final gauge and the cold rolled steel sheet is subjected to a decarburization and a final annealing to develop secondary recrystallized grains of (110) [001] orientation, characterized in that:

1. at least one of S and Se in a total amount of 0.005–0.1%, and one or both of at least one element selected from the group consisting of As, Bi, Pb, P and Sn (hereinafter referred to as X*i*) in a total amount of 0.015–0.4% and at least one element selected from the group consisting of Ni and Cu (hereinafter referred to as X*j*) in a total amount of 0.2–1.0% are contained in the silicon steel raw material prior to the hot rolling,
2. the final cold rolling is carried out at a reduction rate of 40–80%, and
3. the secondary recrystallized grains are fully developed at a temperature of 800–920°C in the final annealing step.

The second aspect of the present invention lies in that:

4. 0.005–0.1% of Sb is additionally contained in the silicon steel raw material prior to the hot rolling.

The present invention will be explained in detail hereinafter.

In the present invention, the above described elements are contained in the silicon steel raw material in the above described amounts. The reason why the amounts of the elements are limited to the above described ranges will be explained by the following experimental data.

For a better understanding of the invention, reference is taken to the accompanying drawings, wherein.

Figure 1A:
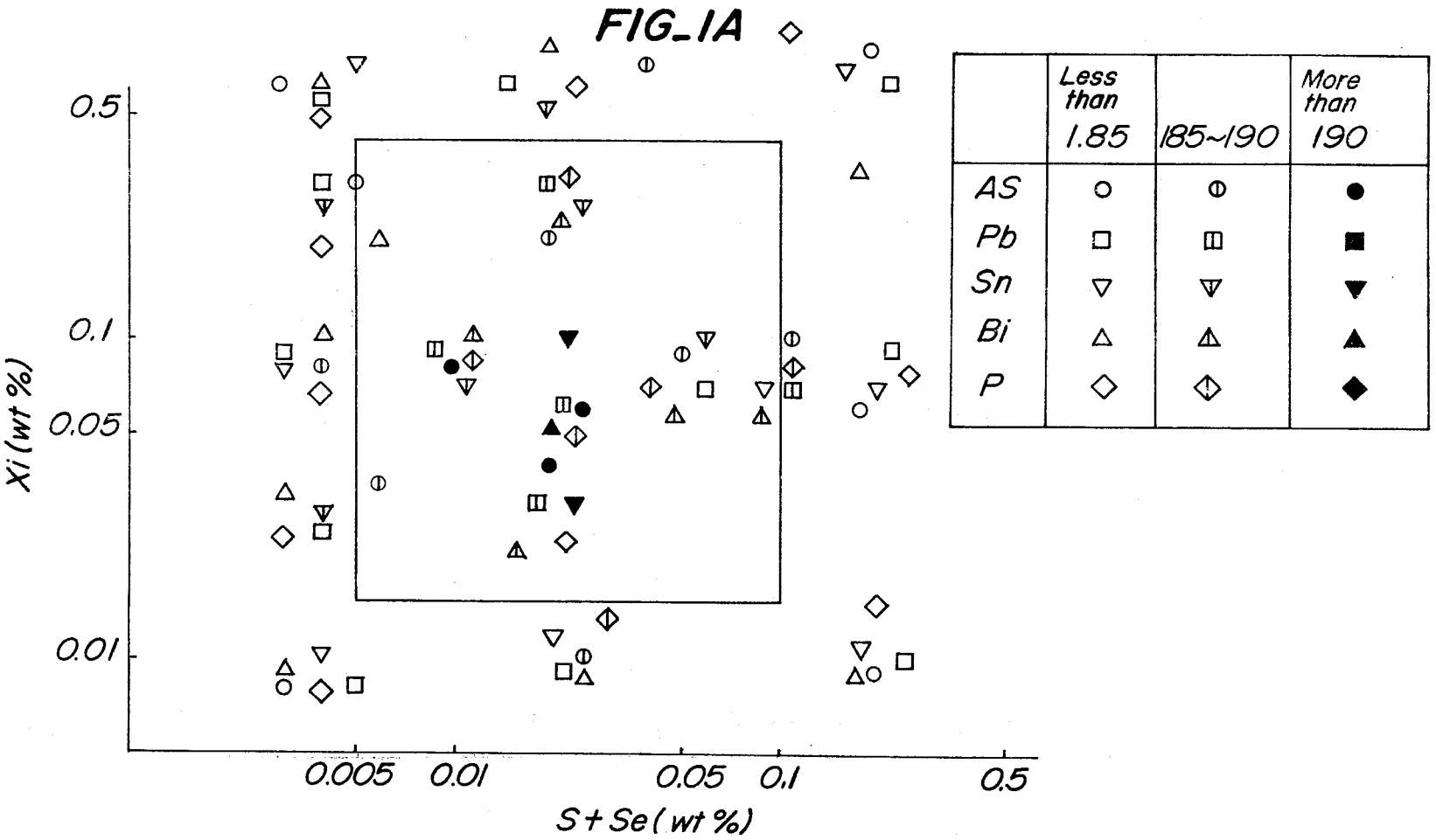
FIGS. 1A and 1B are diagrams showing the influence of the amounts of Se+S and Xi or the amounts of Se+S and X*j* contained in a silicon steel raw material upon the magnetic induction $B_8$ of an electrical steel sheet prepared from the raw material, respectively.
Figure 1B:
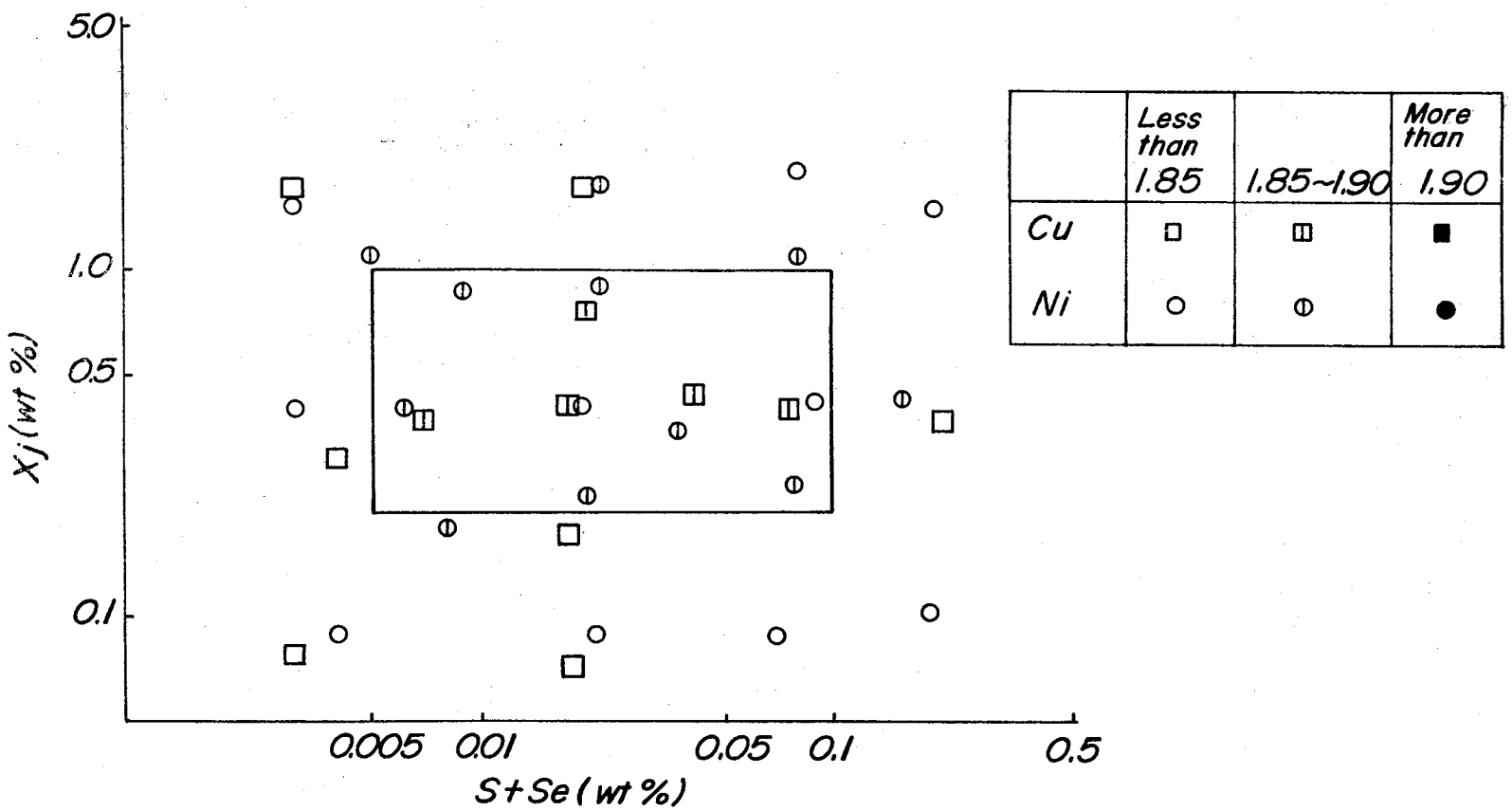

FIGS. 1A and 1B show the influence of the amounts of Se+S and Xi (As, Bi, Pb, P and Sn) and those of Se+S and Xj (Cu and Ni) contained in a silicon steel raw material upon the magnetic induction $B_8$ of an electrical steel sheet prepared in the following manner, respectively. A steel ingot containing about 3% of Si was hot rolled to prepare a hot rolled sheet having a thickness of about 3 mm, and the hot rolled sheet was annealed at 900°C for 5 minutes, cold rolled at a reduction rate of 50–83%, again annealed at 920°C for 5 minutes and finally cold rolled at a reduction rate of 40–80% to prepare a cold rolled steel sheet having a final gauge of 0.30–0.35 mm, and then the cold rolled steel sheet was subjected to a decarburizing annealing at 820°C in a wet hydrogen, a secondary recrystallizing annealing at 860°C for 50 hours and a purifying annealing at 1,200°C for 5 hours in a dry hydrogen to obtain the electrical steel sheet. It can be seen from FIGS. 1A and 1B that when a steel raw material contains 0.005–0.1% os Se+S and further 0.015–0.4% of Xi or 0.2–1.0% of Xj, an electrical steel sheet having an excellent $B_8$ value can be obtained. However, when the amount of Xi is too large, breaks are apt to occur in the cold rolling, and therefore the amount of Xi is preferred to be less than 0.2% in the commercial production of the electrical steel sheet. It has been commonly known that the influence of alloy elements upon the $B_8$ value appears even when the Si % in the steel raw material, the annealing condition of the hot rolled steel sheet, the cold rolling reduction rate, the temperature and time in the intermediate annealing the decarburizing annealing condition, the temperature and time in the secondary recrystallizing annealing, and the final purifying annealing condition are widely varied from the conditions in the above described embodiment. The range of preferable range of these conditions will be explained later. However, in the present invention, the steel raw material must contain Se and/or S and further X*i* or X*j* in the above described ranges, and when the steel raw material contains these elements in the above described ranges, the object of the present invention can be attained. Furthermore, X*i* and X*j* may be contained simultaneously in the steel raw material within the above described ranges in order to attain the object of the present invention. In the present invention, the amount of Si is limited to less than 4% and the amount of C is limited to less than 0.06%. The reason is that when the amounts of Si and C are outside of the above described ranges, respectively, breaks are apt to occur in the cold rolling and further the operation efficiency in the succeeding decarburizing annealing step lowers.

The steel raw material of the present invention may contain well known elements, which are generally added to silicon steel, in addition to the above described Si, C, Se and/or S and Xi and/or Xj. For example, it is preferable to add about 0.02–0.2% of Mn to the raw material in order to prevent breaks in the hot working or to suppress the growth of primary grains due to the formation of MnS (or Se). Further, it is preferable that Te which is well known as an inhibitor for the growth of primary grains, may be replaced with the same amount of Se or S, or may be added to the raw material in addition to Se or S. A very small amount of A*l*, which remains in the raw material after the A*l* was used as a deoxidizer, does not at all adversely affect in the present invention.

Then, the second aspect of the present invention will be explained. The second aspect of the present invention lies in that Sb is further added to the raw material in addition to the elements used in the first aspect of the present invention. It is necessary that the addition amount of Sb should be within the range of 0.005–0.2%. The reason of this limitation will be explained referring to FIG. 2.

Figure 2:
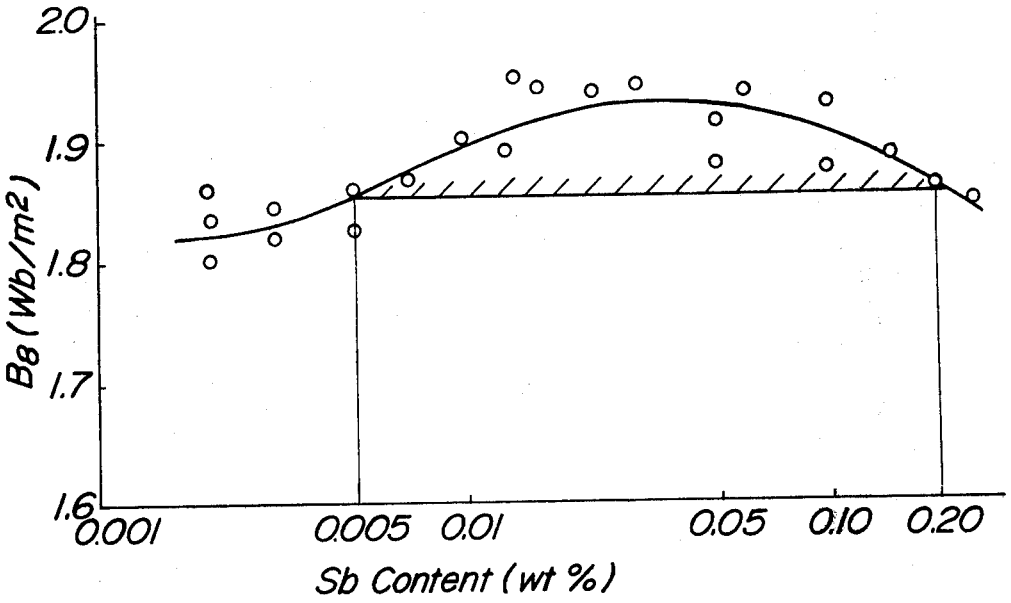
FIG. 2 is a diagram showing the influence of the S*b* content upon the magnetic induction $B_8$ in a steel containing S*b;*

FIG. 2 shows the influence of Sb upon the $B_8$ value of an electrical steel sheet in the case when a hot rolled raw material containing 3% of Si, 0.03% of C, 0.06% of Mn, 0.003% of S, 0.020% of Se, 0.012% of P and 0.020% of As (i.e., 0.032% of Xi) is treated under the same condition as described in the embodiment shown in FIG. 1. It can be seen from FIG. 2 that when the Sb content is within the range of 0.005–0.20%, a high $B_8$ value of 1.85–1.95 $Wb/m^2$ is obtained, and when the Sb content is less than 0.005% or exceeds 0.20%, $B_8$ value lowers.

The raw material of the present invention contains the above described elements in the above described amounts. According to the present invention, such raw material is subjected to the above described successive steps, whereby a final product having a high $B_8$ value is produced.

Figure 3:
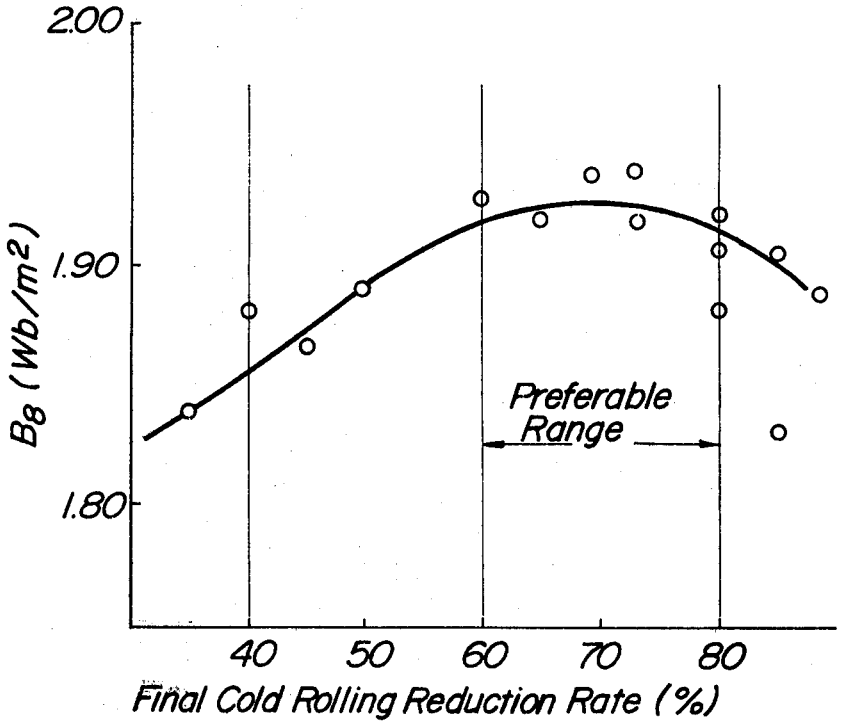
FIG. 3 is a diagram showing the influence of the final cold rolling reduction rate upon the magnetic induction $B_8$.

Hereinafter, the condition for carrying out each step will be explained in detail.

a. The final cold rolling reduction rate:

FIG. 3 shows a relation between the magnetic induction $B_8$ of an electrical steel sheet produced in the following manner and the final cold rolling reduction rate.

Figure 4:
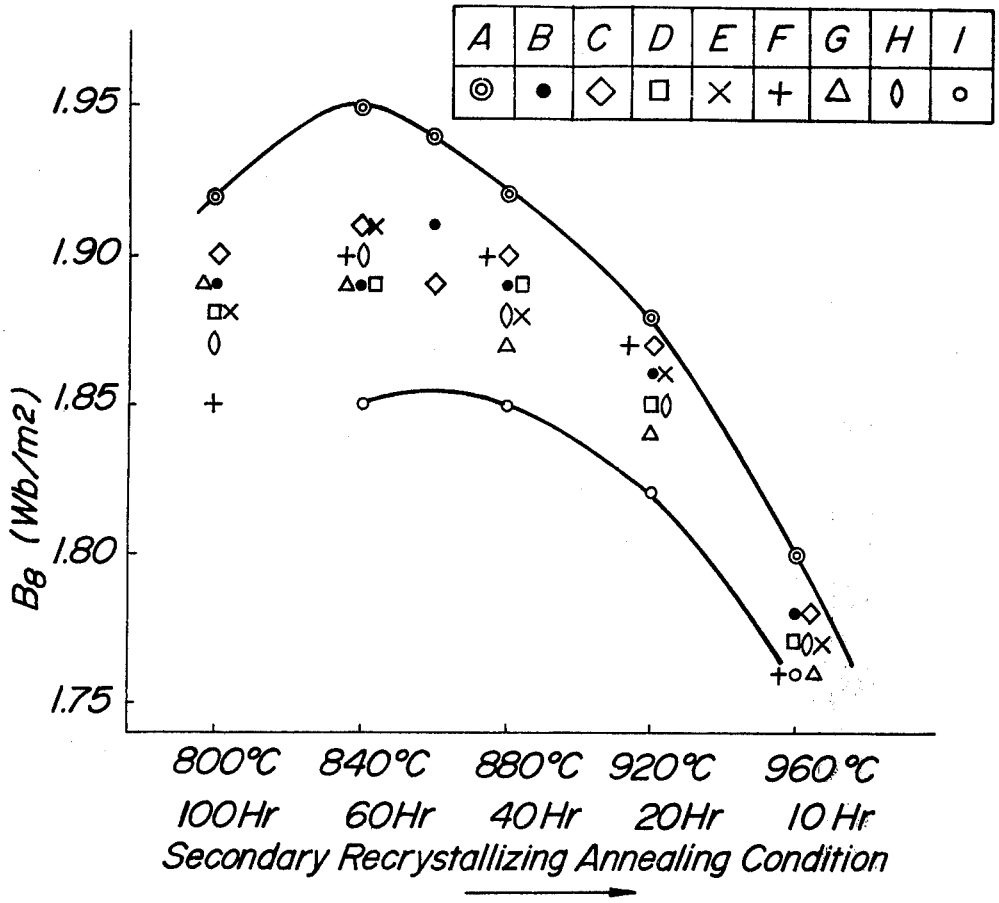
FIG. 4 is a diagram showing the influence of the second recrystallizing annealing temperature upon the magnetic induction $B_8$ in steels containing different elements.

A hot rolled steel sheet having a thickness of 2–5 mm, which contained 0.033% of C, 3.00% of Si, 0.05% of Mn, 0.003% of S, 0.02% of Se, 0.03% of As and 0.03% of Sb, was annealed at 920°C for 3 minutes, cold rolled at a reduction rate of 40–85%, then the cold rolled sheet was annealed at 920°C for 5 minutes and subjected to a final cold rolling by varying the reduction rate within the range of 35–88% to prepare a cold rolled steel sheet having a final gauge of 35–88% to prepare a cold rolled steel sheet having a final gauge of 0.30–0.35 mm, after which the cold rolled steel sheet was decarburized at 820°C in a wet hydrogen and then subjected to a secondary recrystallizing annealing at 850°C for 50 hours and to a purifying annealing at 1,200°C for 5 hours in a dry hydrogen to produce the electrical steel sheet. It can be seen from FIG. 3 that when the final cold rolling reduction rate is 40% or more, $B_8$ value exceeds 1.85 $Wb/m^2$. While, when the final reduction rate is less than 40% the secondary recrystallization occurs fully, but the unevenness of secondary recrystallized grains from the [001] orientation is large, and high $B_8$ value cannot be obtained. Relatively higher final reduction rate gives better aggregation of the secondary recrystallized grains in the [001] orientation, but when the final reduction rate is too high and exceeds 80%, the secondary recrystallization does not occur, and the ratio of the secondary recrystallization becomes lower than 50%, and as the result, $B_8$ value often lowers considerably. Accordingly, the final cold rolling reduction rate is limited to 40–80%. Furthermore, when it is intended to obtain always high $B_8$ value of more than 1.90 $Wb/m^2$, the final cold rolling reduction rate is preferred to be 60–80%.

b. The secondary recrystallizing annealing:

FIG. 4 shows $B_8$ values of electrical steel sheets obtained by treating 3% silicon steels containing different elements (raw materials B-I) by varying only the secondary recrystallizing annealing temperature within the range of 800–960°C. The composition of the raw materials A-I and the treating conditions other than the secondary recrystallizing annealing temperature are shown in the following Table 1.

Table 1

| | Composition (%) | | | | | | | | | | Treating condition | | | | | |
|---|---|---|---|---|---|---|---|---|---|---|---|---|---|---|---|---|
| | S | Se | As | Bi | Pb | Sn | P | Cu | Ni | Sb | Thickness of hot rolled sheet (mm) | First cold rolling reduction rate (%) | Intermediate annealing temperature (°C) | Second cold rolling reduction rate (%) | Final gauge (mm) | Decarburizing annealing temperature (°C) |
| A | 0.003 | 0.017 | 0.03 | — | — | — | — | — | — | 0.03 | 3.0 | 64 | 920 | 72 | 0.30 | 830 |
| B | 0.004 | 0.016 | 0.04 | — | — | — | — | — | — | — | 3.0 | 71 | 920 | 65 | 0.30 | 830 |
| C | 0.003 | 0.017 | — | 0.05 | — | — | — | — | — | — | 3.0 | 71 | 920 | 65 | 0.30 | 820 |
| D | 0.003 | 0.019 | — | — | 0.06 | — | — | — | — | — | 3.0 | 71 | 920 | 65 | 0.30 | 820 |
| E | 0.003 | 0.019 | — | — | — | 0.10 | — | — | — | — | 3.0 | 71 | 920 | 65 | 0.30 | 830 |
| F | 0.003 | 0.020 | — | — | — | — | 0.05 | — | — | — | 3.0 | 71 | 920 | 65 | 0.30 | 830 |
| G | 0.012 | 0.028 | — | — | — | — | — | 0.43 | — | — | 2.5 | 73 | 900 | 55 | 0.30 | 820 |
| H | 0.014 | 0.013 | — | — | — | — | — | — | 0.33 | — | 2.5 | 73 | 900 | 55 | 0.30 | 820 |
| I | 0.003 | 0.015 | — | — | — | — | — | — | — | — | 2.5 | 73 | 900 | 55 | 0.30 | 800 |

Note) The mark of sample is the same with that of sample in FIG. 4.

It can be seen from FIG. 4 that very high $B_8$ value can be obtained at a secondary recrystallizing annealing temperature of not higher than 920°C, which is considerably lower than the conventional secondary recrystallizing annealing temperature of at least 1,000°C, and that the effect is remarkably improved by coexisting Xi and Xj with Se and/or S. Moreover, it is clear that when Sb is additionally contained in the raw material, $B_8$ value is more improved. Such phenomena similarly appear even when the composition and treating condition of raw material are somewhat varied. Accordingly, in the present invention, the second recrystallizing annealing temperature is limited to 800°-920°C.

The present invention aims to obtain high $B_8$ value by combining the following requirements, that is, the coexistence of Se and/or S with Xi and/or Xj, the final cold rolling reduction rate of 40–80%, and the secondary recrystallizing annealing temperature of 800–920°C. However, in order to obtain the best $B_8$ value, it is necessary to take care of the following point. That is, the composition of silicon steel raw material, the first cold rolling reduction rate, intermediate annealing temperature, and the final cold rolling reduction rate should be selected and combined so as to make the secondary recrystallizing temperature as low as possible.

Figure 5A:
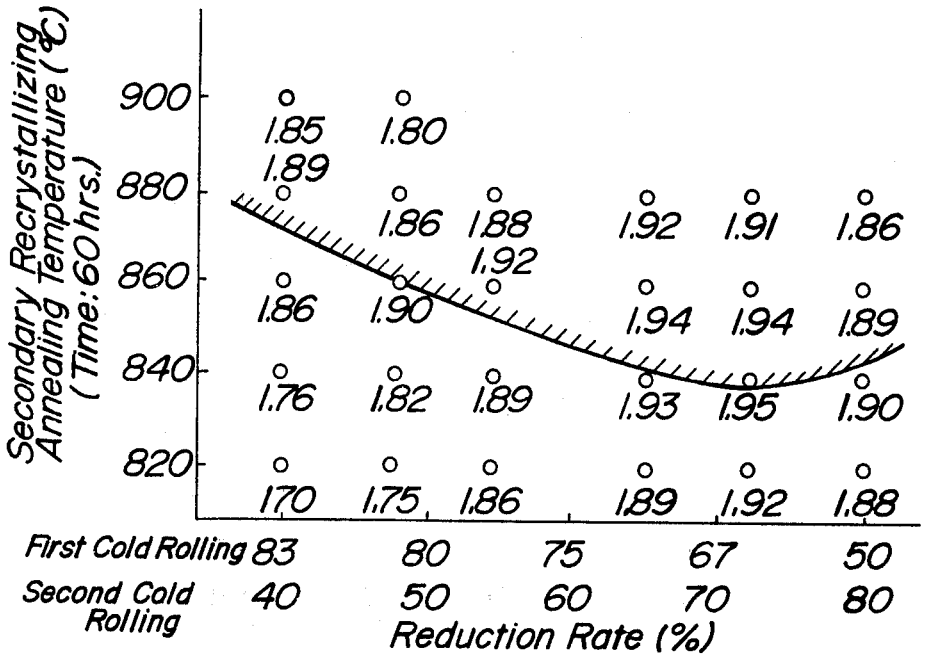
FIGS. 5A and 5B are diagrams showing the influence of the combination of reduction rates at the first and second cold rollings and the second recrystallizing annealing temperature upon the magnetic induction $B_8$ in two kinds of steels, respectively.
Figure 5B:
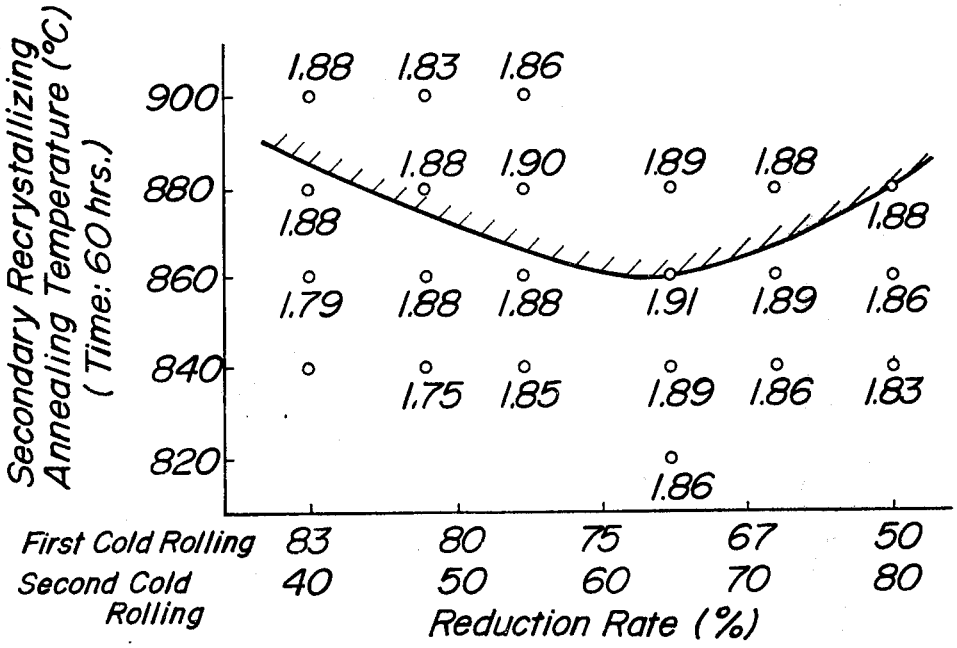

FIGS. 5A and 5B show the magnetic induction $B_8$ of electrical steel sheets A and B prepared in the following manner, which were plotted by using the secondary recrystallizing annealing temperature as the ordinate and the combination of reduction rates in the first and second cold rollings as the abscissa. A steel ingot A containing 0.033% of C, 3.00% of Si, 0.05% of Mn, 0.017% of Se, 0.003% of S, 0.03% of As and 0.03% of Sb, or a steel ingot B containing 0.029% of C, 3.03% of Si, 0.06% of Mn, 0.016% of Se, 0.004% of S and 0.04% of As was hot rolled to prepare a steel sheet having a thickness of about 3 mm, and the hot rolled steel sheet was made into a steel sheet having a final gauge of 0.30 mm under various combinations of reduction rates in the first and second cold rollings, and the finally cold rolled steel sheet was subjected to a decarburizing annealing at 820°C for 10 minutes in a wet hydrogen, to a secondary recrystallizing annealing at various temperatures, and then to a purification annealing at 1,180°C for 5 hours in a dry hydrogen to produce the electrical steel sheet A or B. In FIGS. 5A and 5B, the area above the curve having hatched lines shows an area wherein the ratio of the secondary recrystallizing becomes more than 50% in the case when the secondary recrystallizing annealing is effected for 20 hours. In this area, as the secondary recrystallizing annealing temperature is lower, the time required for the secondary recrystallizing annealing is longer. It can be seen from the comparison of FIG. 5A with FIG. 5B that there is a certain combination of reduction rates in the first and second cold rollings which makes the secondary recrystallizing temperature lowest, and when a secondary recrystallizing annealing is effected at a temperature as low as possible depending upon the commercially applicable secondary recrystallizing annealing time under this combination of reduction rates to develop fully secondary recrystallized grains, the highest $B_8$ value can be obtained. Moreover, it can be seen from the comparison of FIG. 5A with FIG. 5B that the secondary recrystallizing annealing temperature giving the highest $B_8$ value varies depending upon the composition of raw material. In addition to the composition of raw material, all the steps prior to the secondary recrystallizing annealing step influence the secondary recrystallizing annealing temperature. Among them, the combination of reduction rates in the cold rollings is a most important factor. However, in the secondary recrystallizing annealing, as the annealing temperature is lower, a very long annealing time is required in order to develop fully secondary recrystallized grains, and excessively low temperature has no commerical value. Accordingly, in the present invention, the lower limit of the secondary recrystallizing annealing temperature is limited to 800°C.

As described above, it is necessary that the secondary recrystallizing annealing should be effected at a lowest commercially applicable temperature within the range of 800–920°C. In this case, the temperature may be kept constant or raised gradually within this temperature range.

As described above, the facts that there is a combination of treating conditions in the above described steps (particularly, a combination of reduction rates in the cold rollings), which makes the secondary recrystallizing temperature lowest, with respect to a raw material having a proper composition obtained by adding specifically limited elements to a silicon steel, and that when a secondary recrystallizing annealing is effected at a lowest commercially applicable temperature by combining the treating conditions to develop fully secondary recrystallized grains, a very high $B_8$ value can be obtained, have been firstly found out by the inventors. These facts are most important points of the present invention.

according to the present invention, the above described specifically limited conditions in the composition of raw material, the final cold rolling reduction rate and the secondary recrystallizing annealing are combined, whereby electrical silicon steel sheets having an excellent $B_8$ value are produced. The practical production of the electrical silicon steel sheet by the above described successive steps will be explained in detail.

The raw material of the present invention is melted in a well-known melting technic, and formed into a steel ingot. In this case, of course, the contents of $O_2$, $SiO_2$, $Al_2O_3$, etc. are decreased by a vacuum treatment, and a continuous casting method may be adopted. What is important is that the resulting steel ingot has the above described composition. The following Table 2 shows the composition of raw material, the final cold rolling reduction rate, the secondary recrystallizing temperature and the $B_8$ value in the Examples of the present invention. The above obtained steel ingot is hot rolled in a well-known process. Of course, the steel ingot is generally heated to about 1,200–1,350°C prior to the hot rolling, and the thickness of the hot rolled sheet is about 2–4 mm. Following to the hot rolling, the hot rolled sheet is cold rolled. If necessary, an annealing may be effected at about 850°–1,000°C prior to the cold rolling in order to randamize the aggregation structure of the recrystallized grains.

The cold rolling is generally effected two times, between which an intermediate annealing is effected. In this case, the final cold rolling reduction rate is important ad described above. In general, the reduction rates in the cold rollings before the final cold rolling are not so important, but, of course, these reduction rates must be proper values depending upon the final gauge and the thickness of the hot rolled sheet. When the cold rolling is effected two times, the first cold rolling is generally effected at a reduction rate of about 30–80%.

It is necessary to effect the intermediate annealing between the cold rollings. When the intermediate annealing is effected at a temperature, at which a primary recrystallization is completed, the object of the intermediate annealing can be attained. The intermediate annealing temperature is varied depending upon the Si content of raw material, and is usually about 750–1,000°C.

After completion of the cold rolling, the resulting steel sheet having a final gauge is subjected to a conventional decarburizing annealing to decrease the C content in the steel sheet to lower than 0.005% and to form an oxide layer consisting mainly of $SiO_2$ on the surface of the steel sheet. In order to attain the object, a continuous annealing is generally effected at 750°–900°C for about 2–10 minutes in a wet hydrogen.

After completion of the decarburization, a conventional annealing separator consisting mainly of MgO is applied to the steel sheet, and then the steel sheet is subjected to a so-called high temperature annealing. In general, the above described seondary recrystallizing annealing is carried out during the course of this high temperature annealing. That is, a conventional high temperature annealing is effected in such a manner that the temperature is kept at a certain temperature or raised gradually within the range of 800°–920°C, whereby secondary recrystallized grains are fully developed. In the secondary recrystallizing annealing, the annealing time is determined depending upon the annealing temperature and is usually 10–100hours.

When the secondary recrystallized grains have been fully developed, the annealing is stopped. However, in order to remove impurities contained in the steel, it is preferable that the temperature is further raised and the steel is maintained in a dry hydrogen kept at 1,100°–1,200°C for several hour. As seen from the following Table 2, the $B_8$ value of electrical steel sheets obtained by the above described successive steps varies depending upon the Si content in the raw materials, but the $B_8$ value is usually more than 1.88 $Wb/m^2$.

Table 2

| Example No. | Si | C | Mn | S | Se | Sb | Other element | Final cold rolling reduction rate (%) | Secondary recrystallizing annealing temperature (°C) | $B_8$ ($Wb/m^2$) |
|---|---|---|---|---|---|---|---|---|---|---|
| 1 | 3.25 | 0.030 | 0.04 | 0.010 | 0.021 | | As=0.031 | 65 | 850 | 1.90 |
| 2 | 3.16 | 0.038 | 0.05 | 0.010 | 0.020 | | As=0.020 Cu=0.11 | 55 | 870 | 1.88 |
| 3 | 3.24 | 0.025 | 0.05 | 0.015 | 0.020 | 0.020 | As=0.022 P =0.055 | 70 | 840 | 1.92 |
| 4 | 3.20 | 0.032 | 0.05 | 0.004 | 0.020 | 0.015 | As=0.015 Ni=0.50 | 60 | 840 | 1.90 |
| 5 | 3.28 | 0.025 | 0.06 | 0.020 | 0.020 | | Bi=0.015 | 60 | 850 | 1.89 |
| 6 | 3.24 | 0.032 | 0.04 | 0.003 | 0.020 | | Bi=0.04 | 65 | 860 | 1.89 |
| 7 | 3.28 | 0.034 | 0.06 | 0.015 | 0.016 | | Bi=0.013 Pb=0.015 Cu=0.3 | 70 | 840 | 1.92 |
| 8 | 3.19 | 0.040 | 0.06 | 0.003 | 0.015 | | Pb=0.020 | 65 | 850 | 1.88 |
| 9 | 3.21 | 0.042 | 0.07 | 0.003 | 0.040 | 0.012 | Pb=0.015 | 70 | 840 | 1.92 |
| 10 | 3.25 | 0.035 | 0.05 | 0.015 | 0.025 | | P =0.08 | 65 | 860 | 1.90 |
| 11 | 3.22 | 0.026 | 0.06 | 0.030 | | | P =0.062 Sn=0.03 | 70 | 840 | 1.91 |
| 12 | 3.20 | 0.033 | 0.06 | 0.011 | 0.022 | 0.010 | Sn=0.020 | 65 | 850 | 1.92 |
| 13 | 3.29 | 0.031 | 0.06 | 0.004 | 0.020 | 0.028 | Sn=0.032 | 75 | 830 | 1.93 |
| 14 | 3.28 | 0.025 | 0.07 | 0.003 | 0.030 | | Ni=0.35 | 55 | 870 | 1.89 |
| 15 | 3.22 | 0.028 | 0.05 | 0.010 | 0.025 | 0.015 | Ni=0.51 | 60 | 860 | 1.91 |
| 16 | 2.35 | 0.028 | 0.05 | 0.004 | 0.021 | 0.032 | Sn=0.035 | 75 | 820 | 1.98 |
| 17 | 2.30 | 0.030 | 0.05 | 0.015 | 0.020 | 0.010 | Ni=0.33 Cu=0.20 | 60 | 820 | 1.97 |

What is claimed is:

1. In a method for producing single-oriented electrical steel sheets having a magnetic induction of more than 1.85 $wb/m^2$ including the steps of preparing raw material for the sheets, hot rolling the raw material to a hot strip having an intermediate gauge of 2–/4mm, subjecting said hot strip to repeated annealing and cold rolling steps including a final cold rolled steel sheet having its final gauge and subjecting the resulting sheets to a decarburization annealing and a final annealing to develop secondary recrystallized grains of (110) [001] orientation; the improvement comprising utilizing a raw material formulation consisting essentially of less than 4% of Si less than 0.06% of C, 0.02–0.2% of Mn, 0.005–0.1% in total of at least one of S and Se, at least one member selected from the group consisting of 0.015–0.4% of elements (Xi) and 0.2–1.0% of elements (X*j*), said element (X*i*) being at least one of As, Bi, Pb, P, Sn,; and said element (X*j*) being at least one of Ni and Cu, with the remainder of the materials being iron; said improvement further comprising a two-step final annealing including a secondary recrystallization annealing at a temperature of 800°-920°C. to fully develop the secondary recrystallized grains and a purification annealing at a temperature of 1,100°–1,200°C.

2. The method as claimed in claim 1, wherein 0.005–0.2% of S*b* is additionally contained in the silicon steel raw material prior to the hot rolling.

3. The method of claim 1 in which the $B_8$ value is maximized by correlating the secondary recrystallization temperature and the final cold rolling reduction rate.

* * * * *